US012421587B2

(12) United States Patent
Ollat et al.

(10) Patent No.: US 12,421,587 B2
(45) Date of Patent: Sep. 23, 2025

(54) WROUGHT PRODUCTS MADE OF 2XXX ALLOY HAVING AN OPTIMIZED CORROSION RESISTANCE, AND METHOD FOR OBTAINING SAME

(71) Applicant: CONSTELLIUM ISSOIRE, Issoire (FR)

(72) Inventors: Melanie Ollat, Ruy-Montceau (FR); Jean-Christophe Ehrstrom, Grenoble (FR)

(73) Assignee: C-TEC Constellium Technology Center, Voreppe (FR)

( * ) Notice: Subject to any disclaimer, the term of this patent is extended or adjusted under 35 U.S.C. 154(b) by 338 days.

(21) Appl. No.: 18/254,386

(22) PCT Filed: Dec. 16, 2021

(86) PCT No.: PCT/FR2021/052370
§ 371 (c)(1),
(2) Date: May 25, 2023

(87) PCT Pub. No.: WO2022/129806
PCT Pub. Date: Jun. 23, 2022

(65) Prior Publication Data

US 2024/0035137 A1 Feb. 1, 2024

(30) Foreign Application Priority Data

Dec. 18, 2020 (FR) ..... 2013653

(51) Int. Cl.

| | |
|---|---|
| ***C22F 1/057*** | (2006.01) |
| ***C22C 21/14*** | (2006.01) |
| ***C22C 21/16*** | (2006.01) |
| ***C22C 21/18*** | (2006.01) |
| ***C22F 1/00*** | (2006.01) |

(52) U.S. Cl.
CPC ..... *C22F 1/057* (2013.01); *C22C 21/14* (2013.01); *C22C 21/16* (2013.01); *C22C 21/18* (2013.01); *C22F 1/002* (2013.01)

(58) Field of Classification Search
None
See application file for complete search history.

(56) References Cited

U.S. PATENT DOCUMENTS

| | | | |
|---|---|---|---|
| 2,159,010 | A | 5/1939 | Dix et al. |
| 3,305,410 | A | 2/1967 | Robert et al. |
| 8,333,853 | B2 | 12/2012 | Giummarra et al. |
| 2010/0180992 | A1 | 7/2010 | Giummarra et al. |
| 2021/0388470 | A1 | 12/2021 | Chevy et al. |

FOREIGN PATENT DOCUMENTS

| | | | |
|---|---|---|---|
| FR | 2435535 | A1 | 4/1980 |
| WO | 2004106566 | A2 | 12/2004 |
| WO | 2017037371 | A1 | 3/2017 |
| WO | 2020074818 | A1 | 4/2020 |
| WO | 2020123096 | A2 | 6/2020 |

OTHER PUBLICATIONS

French Search Report issued in French Application No. 2013653 (Sep. 14, 2021).
International Search Report issued in International Application No. PCT/FR2021/052370 (May 13, 2022).
N. Magaji et al. "Comparison of test methods used to analyze the stress corrosion cracking of differently tempered 7xxx alloys"—Materials and Corrosion 2019—vol. 70—pp. 1192-1204—Abstract included.

*Primary Examiner* — Anthony M Liang
(74) *Attorney, Agent, or Firm* — McBee Moore & Vanik IP, LLC

(57) ABSTRACT

A method for thermomechanical treatment of wrought products made of a 2000 series aluminum alloy comprising, in % by weight, Cu 3.5-5.8; Mg 0.2-1.5; Mn≤0.9; Fe≤0.15; Si≤0.15; Zr≤0.25; Ag≤0.8; Zn≤0.8; Ti 0.02-0.15; unavoidable impurities≤0.05 each and ≤0.15 total; remainder aluminum, enabling an improvement in the resistance to corrosion under stress. It includes a tempering consisting of two sequences. The first sequence is defined by a maximum temperature $T1^{max}$ comprised between 130° C. and 180° C. and by a hold time at a temperature comprised between 130° C. and 180° C. which equates to an equivalent duration $t1_{eq}^{160+\,C.}$ calculated at 160° C. comprised between 10 h and 80 h. The second sequence is defined by a temperature $T2^{\circ\,C.}(t)$ lower than $T1^{max}$ and a hold time t2 at a temperature comprised between 100° C. and 130° C., which equates to an equivalent time $t2_{eq}^{160^\circ\,C.}$ calculated at 160° C. such that $t2_{eq}^{160o}$ comprised between 0.3% and 15% of the equivalent duration $t1_{eq}^{160o}$ calculated for the first sequence.

12 Claims, 3 Drawing Sheets

[Fig. 1]
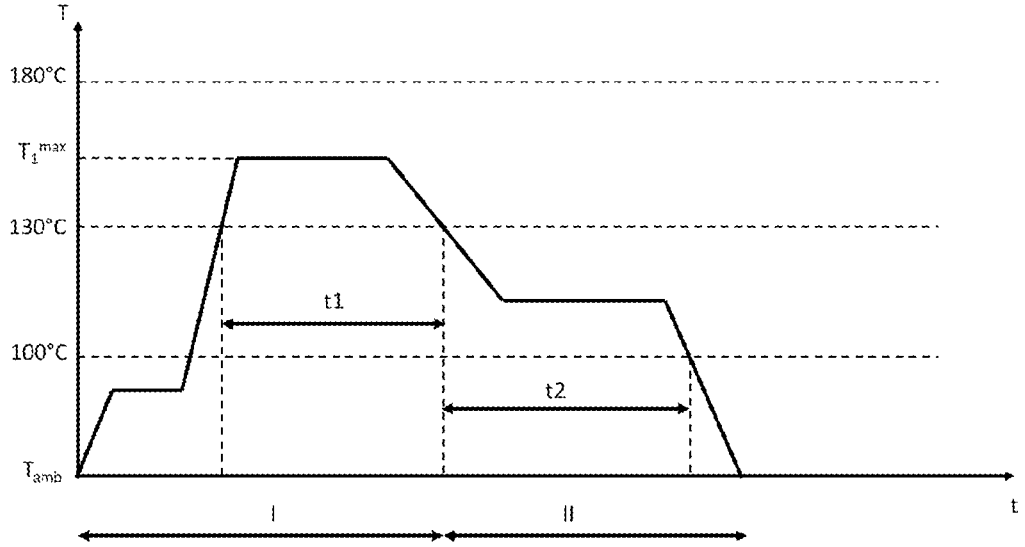
[Fig. 2]
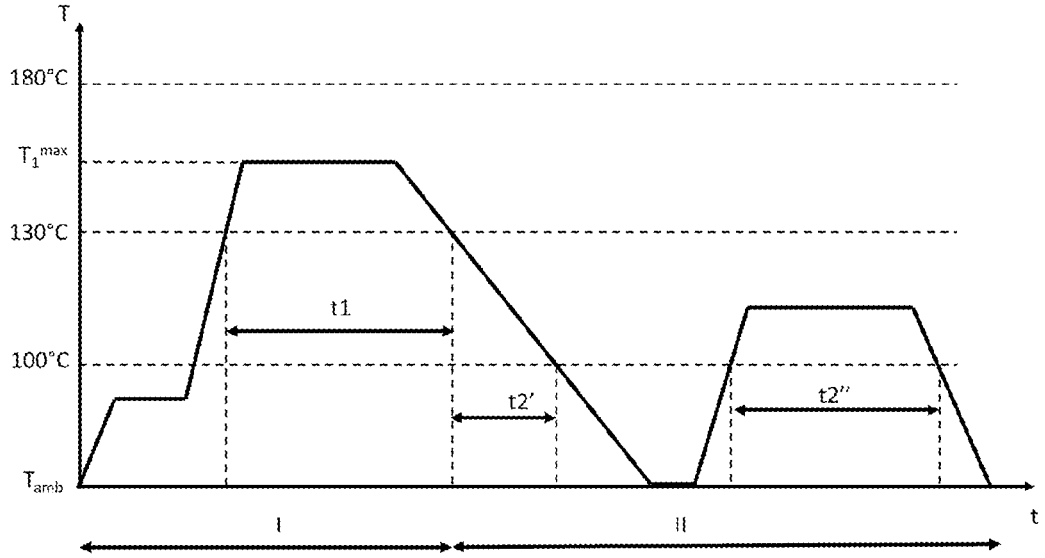

[Fig. 3]
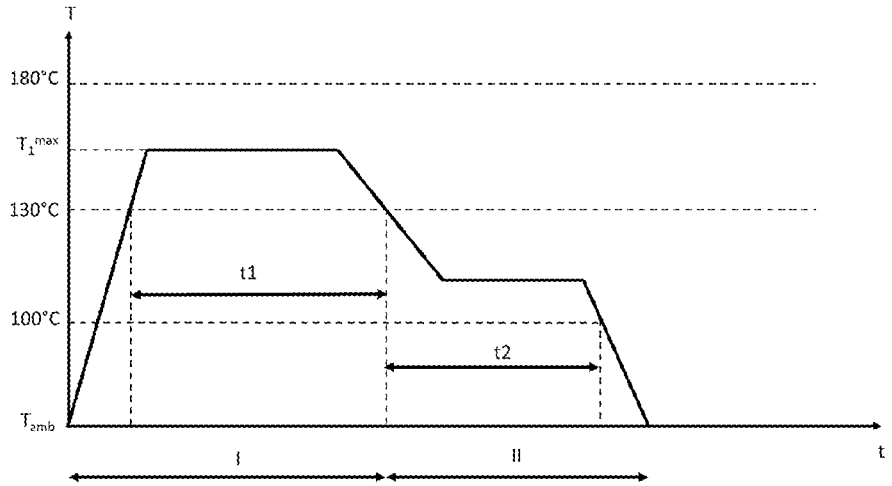
[Fig. 4]
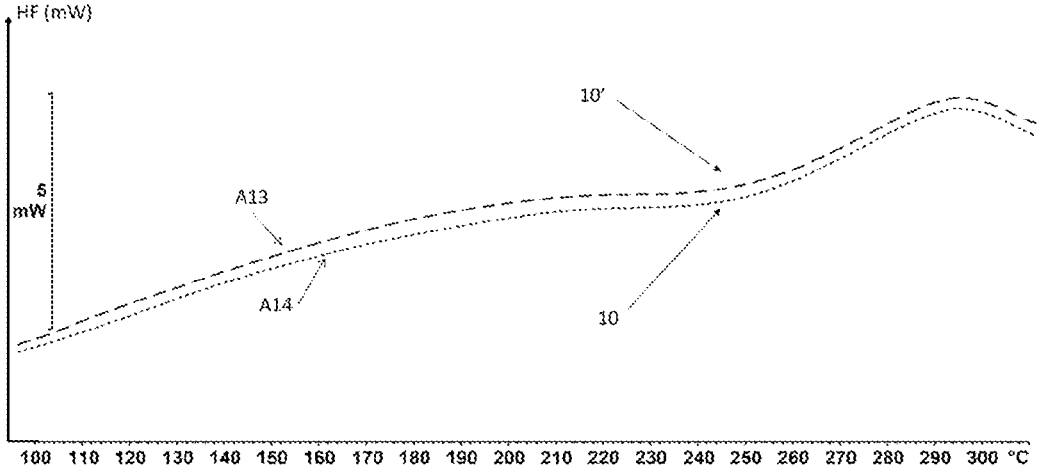

[Fig. 5]
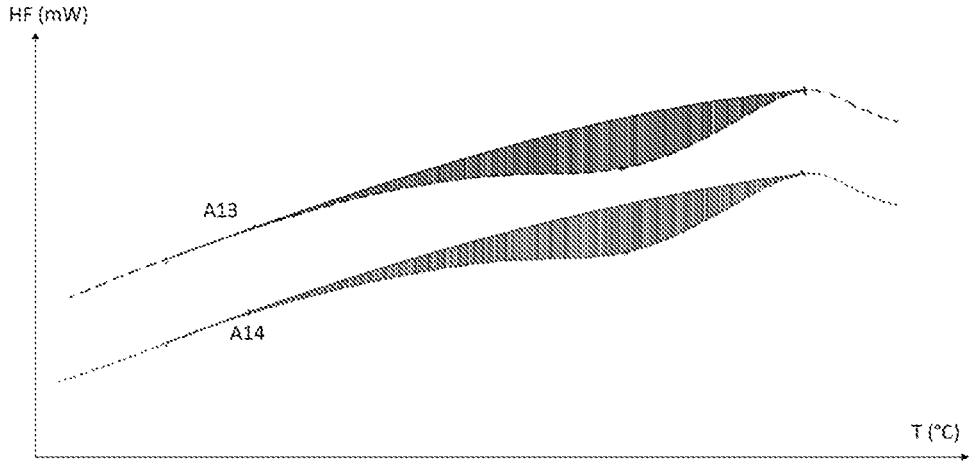

WROUGHT PRODUCTS MADE OF 2XXX ALLOY HAVING AN OPTIMIZED CORROSION RESISTANCE, AND METHOD FOR OBTAINING SAME

CROSS-REFERENCE TO RELATED APPLICATIONS

This application is a National Stage entry of International Application No. PCT/FR2021/052370, filed 16 Dec. 2021, which claims priority to French Patent Application No. 2013653, filed 18 Dec. 2020, the entire contents of each of which are incorporated herein by reference.

BACKGROUND

Field

The present invention relates to a wrought product made of a 2XXX alloy having improved stress corrosion properties and a method for the thermomechanical treatment of wrought products made of a 2XXX series aluminum alloy intended to improve their resistance to corrosion under stress while keeping an excellent tradeoff between yield strength, ductility, and damage tolerance, in particular toughness.

Description of Related Art

Aeronautical applications generally require a very specific set of properties. In general, alloys with a high mechanical strength are desired, but depending on the intended use, other properties such as high breaking strength or ductility, as well as good corrosion resistance are usually required, in particular, resistance to corrosion under stress. The resistance to corrosion under stress of a 2000 alloy is assessed after alternating immersion-emersion test according to the standard ASTM G47-98 (2019). In general, products over 30 mm are tensile tested according to the standard ASTM G49-85 (2019). Depending on the selected device, the test is carried out under constant deformation or under constant load. The selection depends on the intended application and the selection criteria. As mentioned in the standard ASTM G49-85 (2019), corrosion tests under tensile stress under constant load are more severe than corrosion tests under tensile stress under constant strain. Thus, the acceptable maximum stress defined by a corrosion test under tensile stress under constant load is generally lower than or equal to that determined by a corrosion test under tensile stress under constant strain. This difference is related to the fact that under constant strain, in particular when a crack appears, there is a relief of the stresses. The product is then subjected to a lower load than the initial load, which makes the test less severe. The article by N. Magaji et al. "Comparison of test methods used to analyze the stress corrosion cracking of differently tempered 7xxx alloys"—Materials and Corrosion—2019—Vol. 70—pp 1192-1204 could also be mentioned.

The 2000 alloys are known from the prior art. In this text, it is possible to use the term 2000 or 2xxx interchangeably to refer to aluminum alloys whose predominant element is the element Cu.

WO2004/106566 discloses an aluminum alloy having improved strength and ductility, comprising Cu 3.5 to 5.8% by weight, Mg 0.1 to 1.8% by weight, Mn 0.1-0.8% by weight, Ag 0.2-0.8% by weight, Ti 0.02-0.12% by weight and possibly one or more elements selected from the group including Cr 0.1-0.8% by weight, Hf 0.1-1.0% by weight, Sc 0.03-0.6% by weight, and V 0.05-0.15% by weight, the remainder being aluminum, and wherein the alloy is substantially free of zirconium.

WO2020/123096 discloses a 2XXX alloy, with a titanium content comprised between 0.08 and 0.20% by weight which has an excellent tradeoff of at least two characteristics like mechanical strength, toughness, elongation and resistance to corrosion. This application discloses stress corrosion tests performed under constant strain.

Standard practice for the final thermomechanical treatment of these alloys after hot-rolling comprises placing in solution, quenching as quickly as possible, cold strain of at least 2% and tempering with a single isothermal step level.

The Inventors have noticed that the products according to WO2004/106566 do not allow obtaining a lifespan of more than 10 days after corrosion tests under tensile stress under constant load at 200 MPa when these products have been obtained according to the standard thermomechanical treatment practice.

FR2435535 discloses a method for heat treatment of wrought products made of a 2000 series aluminum alloy containing (in % by weight) from 3.5 to 5% copper, from 0.2 to 0.1% magnesium, from 0, 25 to 1.2% silicon with an Si/Mg ratio greater than 0.8 characterized in that the tempering includes at least two steps a main tempering at a temperature higher than 225° C. and lower than 285° C. with a duration comprised between 6 s and 60 min and a complementary tempering at a temperature comprised between 120° C. and 175° C. for a duration comprised between 4 and 192 hours. FR2435535 differs from the invention in that it applies to products whose silicon content is greater than 0.25% by weight and in that the first tempering step is performed at a temperature higher than 225° C.

U.S. Pat. No. 3,305,410 discloses a two-step level tempering heat treatment for aluminum alloys to improve corrosion resistance. This tempering is referred to as "top-down" tempering. The first step level is carried out at high temperature, typically between 190° C. and 218° C., so as to initiate homogeneous precipitation and minimize precipitation at the grain boundaries. The second step level is carried out at a lower temperature, typically between 135° C. and 163° C., so as to complete the precipitation. According to the invention, it is important that the hardening precipitation does not change significantly during the second step level. This is possible by selecting the tempering conditions according to the invention.

The invention relates to a thermomechanical treatment method applied to 2XXX alloys with a composition in % by weight Cu 3.5-5.8; Mg 0.2-1.5; Mn≤0.9; Fe≤0.15; Si≤0.15; Zr≤0.25; Ag≤0.8; Zn≤0.8; Ti 0.02-0.15, unavoidable impurities≤0.05 each and ≤0.15 total; remainder aluminum allowing improving resistance to corrosion under stress while allowing obtaining an excellent tradeoff between yield strength, ductility, and tolerance to damage, in particular toughness. In particular, the method allows improving resistance to corrosion under tensile stress under constant load.

SUMMARY

The invention relates to a method for the thermomechanical treatment of wrought products made of a 2000 series aluminum alloy comprising, in % by weight, Cu 3.5-5.8; Mg 0.2-1.5; Mn≤0.9; Fe≤0.15; Si≤0.15; Zr≤0.25; Ag≤0.8; Zn≤0.8; Ti 0.02-0.15, unavoidable impurities≤0.05 each and ≤0.15 total; remainder aluminum. This thermomechanical treatment comprises placing in solution, quenching, work hardening, and tempering. Tempering is characterized in that it comprises at least two sequences:

a first sequence whose temperature expressed in ° C. is described by a function $T1^{\circ C.}(t)$ dependent on the time t, such that the reached maximum temperature $T1^{max}$ is comprised between 130° C. and 180° C. and the hold time t1 at a temperature comprised between 130° C. and 180° C. is such that the equivalent duration $t1_{eq}^{160°}$ is comprised between 10 h and 80 h, which equivalent duration $t1_{eq}^{160°}$ is calculated at a temperature of 160° C. according to the formula $$t1_{eq}^{160°C.} = \int dt \cdot \exp\left[-\frac{136000}{8,314} \cdot \left(\frac{1}{T1^{°C.}(t)+273} - \frac{1}{160+273}\right)\right] \quad \text{[Math 1]}$$

and a second sequence whose temperature expressed in ° C. is described by a function $T2^{\circ C.}(t)$ dependent on the time t whose temperature is such that $T2^{\circ C.}(t)$ is lower than $T1^{max}$ and whose hold time t2 expressed in hours at a temperature comprised between 100° C. and 130° C. is such that the equivalent duration $t2_{eq}^{160°}$ calculated at a temperature of 160° C. according to the formula $$t2_{eq}^{160°C.} = \int dt \cdot \exp\left[-\frac{136000}{8,314} \cdot \left(\frac{1}{T2^{°C.}(t)+273} - \frac{1}{160+273}\right)\right] \quad \text{[Math 2]}$$

is comprised between 0.3% and 15% of the equivalent duration $t1_{eq}^{160°}$ calculated for the first sequence.

In a preferred embodiment, the temperature $T2^{\circ C.}(t)$ of the second sequence is lower than 130° C.

In a preferred embodiment, the hold time t2 of the second sequence comprised between 105° C. and 130° C., preferably between 105° C. and 125° C. or between 110° C. and 130° C., or between 110° C. and 125° C., corresponds to an equivalent duration $t2_{eq}^{160°}$ comprised between 0.3% and 15% of the equivalent duration $t1_{eq}^{160°}$ calculated for the first sequence.

Preferably, the equivalent duration $t2_{eq}^{160°}$ is longer than or equal to 0.4% of the equivalent duration $t1_{eq}^{160°}$ calculated for the first sequence, still more preferably the equivalent duration $t2_{eq}^{160°}$ is longer than or equal to 0.5% or 1% or 2% or 3% of the equivalent duration $t1_{eq}^{160°}$ calculated at 160° C.

In a preferred embodiment, the equivalent duration $t2_{eq}^{160°}$ is shorter than or equal to 10% of the equivalent duration $t1_{eq}^{160°}$ calculated for the first sequence, still more preferably the equivalent duration $t2_{eq}^{160°}$ is shorter than or equal to 5%, or 3.5%.

Preferably, the first sequence comprises one single isothermal step level.

Preferably, the wrought product is a thin sheet metal or a thick sheet metal or a profile or a forged part. In a preferred embodiment, the wrought product is a thick sheet metal or a profile or a forged part with a thickness larger than or equal to 30 mm, preferably 50 mm, still more preferably larger than or equal to 90 mm.

In a preferred embodiment, the wrought product is a thick sheet metal having undergone a step of forming by high-energy hydroforming before tempering, preferably forming by explosion hydroforming.

Preferably, the wrought product made of a 2000 series aluminum alloy is selected from among the designations AA2139, AA2039, AA2040, AA2124, AA2024, AA2027, AA2022, AA2042.

Preferably, the wrought product made of a 2000 series aluminum alloy comprises, in % by weight, Cu 3.9-5.2; Mg 0.2-0.9; Mn 0.1-0.6; Fe≤0.15; Si≤0.5; Zr≤0.15; Ag≤0.6; Zn≤0.8; Ti 0.02-0.15, unavoidable impurities≤0.05 each and ≤0.15 total; remainder aluminum.

Preferably, the wrought product made of a 2000 series aluminum alloy comprises, in % by weight, Cu 4.5-5.0; Mg 0.40-0.90; Mn 0.20-0.50; Fe≤0.15; Si≤0.15; Zr≤0.05; Ag 0.10-0.50; Zn≤0.5; Ti 0.02-0.15, unavoidable impurities≤0.05 each and ≤0.15 total; remainder aluminum.

Preferably, the value of the surface area of the dissolution peak, after the second sequence, measured by DSC, which dissolution peak is comprised between about 200° C. and 300° C., is substantially equal to the value of the surface area of the dissolution peak measured after the first sequence, by substantially equal, it should be understood a difference less than or equal to 5%, advantageously less than or equal to 2%.

Moreover, the invention relates to a wrought product made of a 2000 series aluminum alloy with a thickness larger than or equal to 30 mm comprising, in % by weight, Cu 3.5-5.8; Mg 0.2-1.5; Mn≤0.9; Fe≤0.15; Si≤0.15; Zr≤0.25; Ag≤0.8; Zn≤0.8; Ti 0.02-0.15, unavoidable impurities≤0.05 each and ≤0.15 total; remainder aluminum; obtainable by the thermomechanical treatment method according to the invention. This product is characterized in that the average service life under corrosion at a stress lower than or equal to 200 MPa applied in the short transverse direction TC is longer than 10 days for three specimens per case, the tests being carried out according to the conditions of ASTM G47-98 (2019) using a tensioning device under constant load according to ASTM G49-85 (2019).

Preferably, the wrought product made of a 2000 series aluminum alloy with a thickness larger than or equal to 30 mm is such that the lifespan of all specimens tested in the short transverse direction TC at a stress lower than or equal to 200 MPa under the conditions of ASTM G47-98 (2019) using a tensioning device under constant load according to ASTM G49-85 (2019) is longer than or equal to 10 days.

Preferably, the wrought product made of a 2000 series aluminum alloy with a thickness larger than or equal to 30 mm has a yield strength in the long transverse direction TL higher than or equal to 400 MPa.

Preferably, the wrought product made of a 2000 series aluminum alloy with a thickness larger than or equal to 30 mm comprises, in % by weight, Cu 3.9-5.2; Mg 0.2-0.9; Mn 0.1-0.6; Fe≤0.15; Si≤0.15; Zr≤0.15; Ag≤0.6; Zn≤0.8; Ti 0.02-0.15, unavoidable impurities≤0.05 each and ≤0.15 total; remainder aluminum.

Preferably, the wrought product made of a 2000 series aluminum alloy with a thickness larger than or equal to 30 mm comprises, in % by weight, Cu 4.5-5.0; Mg 0.40-0.90; Mn 0.20-0.50; Fe≤0.15; Si≤0.15; Zr≤0.05; Ag 0.10-0.50; Zn≤0.5; Ti 0.02-0.15, unavoidable impurities≤0.05 each and ≤0.15 total; remainder aluminum.

Advantageously, the product according to the invention or obtained according to the method is used for aeronautical applications in integral structures such as fuselage, rib or spar elements.

BRIEF DESCRIPTION OF THE DRAWINGS

FIG. 1 is a schematic representation of the tempering of an embodiment of the invention where the two sequences are carried out successively without any step at room temperature.

FIG. 2 shows a schematic representation of the tempering of an embodiment of the invention where the two sequences are carried out successively through a step at room temperature.

FIG. 3 shows a schematic representation of the tempering of an embodiment of the invention where the first sequence is a single step level.

FIG. 4 shows the thermograms obtained after measurement by differential scanning calorimetry or DSC on samples A13 and A14 of Example 6.

FIG. 5 illustrates the determination of the value of the surface area of the dissolution peak after DSC measurement.

DETAILED DESCRIPTION OF THE INVENTION

Unless stated otherwise, all indications regarding the chemical composition of the alloys are expressed as a percentage by weight based on the total weight of the alloy. The expression 1.4 Cu means that the copper content expressed in % by weight is multiplied by 1.4. The alloys are designated in accordance with the Aluminum Association rules, known to a person skilled in the art. The density depends on the composition and is determined by calculation rather than by a weight measurement method. The values are calculated in accordance with The Aluminum Association procedure, which is described on page 2-12 and 2-13 of "Aluminum Standards and Data".

Unless stated otherwise, the definitions of the metallurgical states indicated in the European standard EN 515 (1993) apply.

Unless stated otherwise, the static mechanical characteristics, in other words the breaking strength Rm, the conventional yield strength at 0.2% of elongation Rp0.2 ("yield strength") and the elongation at break A %, are determined by a tensile test according to the standard EN 10002-1, the sampling and the direction of the test being defined by standard EN 485-1.

Unless stated otherwise, the stress intensity factor ($K_Q$) is determined according to the standard ASTM E 399. The standard ASTM E 399 gives the criteria for determining whether $K_Q$ is a valid value of $K_{1C}$. For a given specimen geometry, the $K_Q$ values obtained for different materials are comparable with each other provided that the yield strengths of the materials are of the same order of magnitude.

Stress corrosion tests have been performed according to the standards ASTM G47-98 (2019) and ASTM G49-85 (2019) in the short transverse direction TC for specimens centered at mid-thickness. Unless stated otherwise, stress corrosion tests are carried out using tensile specimens. Typically, the tensile specimens are cylindrical with a diameter of 3.17±0.01 mm. Nonetheless, it is possible to use flat specimens. These specimens are tested at a given stress using a device ensuring a constant load according to the recommendations of ASTM G49-85 (2019). At least three specimens are tested for each case.

Unless stated otherwise, the terms used for the aluminum and aluminum alloy products are defined by the standard NF EN 12258-1. In particular, unless stated otherwise, a thin sheet metal is a rolled product with a rectangular cross-section whose uniform thickness is comprised between 0.20 mm and 6 mm. A rolled product with a thickness larger than 6 mm is called thick sheet metal.

A wrought product resistant to corrosion under stress in the short transverse direction, i.e. TC, means that the product does not feature any rupture before 10 days of testing at a stress of 200 MPa applied in the short transverse direction, using a device ensuring a constant load according to the recommendations of ASTM G49-85 (2019). The product according to the invention is resistant to corrosion under stress in the short transverse direction. In a preferred mode, the product has an average lifespan and a standard deviation such that the difference between the average lifespan and the standard deviation is longer than 10 days.

Unless stated otherwise, tempering is a heat treatment intended to modify the properties of a product by precipitation of the intermetallic phases from the supersaturated solution. According to the prior art, it may consist of one or more step(s). By "step", it should be understood a temperature rise phase or an isothermal step level or a cooling phase. The rise and/or cooling phases may be linear and defined by a heating or cooling rate.

According to the invention, a "sequence" consists of one or more step(s). A sequence may be defined by a curve of temperature as a function of time $T^{\circ C.}(t)$.

For a step or a sequence, it is possible to calculate a hold time equivalent to a reference temperature $T_{ref}$.

According to the invention, the tempering temperatures mentioned in the application preferably have an accuracy of +/−5° C., still more preferably +/−3° C.

The hold time of a sequence defined by $T^{\circ C.}(t)$ for a time interval comprised between t' and t" is equivalent to a duration $t_{eq}^{T_{ref}}$ of a sequence carried out at a reference temperature $T_{ref}$.

$t_{eq}^{T_{ref}}$ is defined by the formula:

$$t_{eq}^{T_{ref}} = \int_{t'}^{t''} dt \cdot \exp\left[-\frac{Q}{R} \cdot \left(\frac{1}{T^{\circ C.}(t) + 273} - \frac{1}{T_{ref} + 273}\right)\right] \quad \text{[Math 3]}$$

Where $T^{\circ C.}(t)$ is the instantaneous temperature in ° C. of a sequence which evolves over time t (in hours), and Tref is the reference temperature. $t_{eq}^{T_{ref}}$ is expressed in hours. The constant Q corresponds to the activation energy for diffusion. According to the invention, the constant Q is considered equal to 136,000 J/mol which corresponds to the activation energy of the diffusion of copper Cu in aluminum. The ideal gas constant R is equal to 8.314 J/K/mol.

The wrought product made of a 2000 series aluminum alloy comprises in % by weight Cu 3.5-5.8; Mg 0.2-1.5; Mn≤0.9; Fe≤0.15; Si≤0.15; Zr≤0.25; Ag≤0.8; Zn≤0.8; Ti 0.02-0.15, unavoidable impurities≤0.05 each and ≤0.15 total; remainder aluminum. The Cu content is at least 3.5% by weight, preferably at least 3.9% by weight, advantageously at least 4.1% and still more preferably at least 4.4% by weight in order to obtain a sufficient yield strength. The Cu content is at most 5.8% by weight, preferably at most 5.2%, advantageously at most 5.0% by weight. In one embodiment, the wrought product has a Cu content comprised between 3.9 and 5.2% by weight, advantageously between 4.5 and 5.0% by weight. A too low value of the copper content leads to too low mechanical strength and yield strength. A too high copper content value leads to an insufficient toughness.

The Mg content is at least 0.2% by weight, preferably at least 0.20% by weight, advantageously at least 0.40% by weight. The Mg content is at most 1.5% by weight, preferably at most 0.9%, still more preferably 0.90% by weight. In one embodiment, the wrought product has a Mg content is comprised between 0.2 and 0.9% by weight, advantageously between 0.40 and 0.90% by weight. A too low value of the magnesium content leads to too low mechanical strength and yield strength. A too high magnesium content value leads to insufficient toughness.

Preferably, the Mn content is at least 0.05% by weight, still more preferably at least 0.1% and still more preferably at least 0.20% by weight. The Mn content is at most 0.9% by weight, preferably at most 0.6% by weight, still more preferably at most 0.50% by weight. In one embodiment, the Mn content is comprised between 0.1 and 0.6% by weight, preferably between 0.20 and 0.50% by weight. The addition of manganese allows controlling the growth of recrystallization grains, and thus allows increasing the mechanical strength of the product and its yield strength, but a too high content leads to a drop in toughness.

The Zr content is at most 0.25% by weight, preferably at most 0.15% by weight, still more preferably at most 0.05% by weight. In one embodiment, the Zr content is less than or equal to 0.04% by weight, advantageously the Zr content is less than or equal to 0.01% by weight. The Inventors have noticed that a Zr content of less than or equal to 0.05% by weight allows improving the formability of the product. In another preferred embodiment, the Zr content is comprised between 0.05 and 0.15% by weight.

The Ag content is at most 0.8% by weight, preferably at most 0.6%. In a preferred embodiment, the Ag content is comprised between 0.10 and 0.50% by weight.

The Zn content is at most 0.8% by weight. In one embodiment, the Zn content is less than 0.5%, advantageously less than 0.25%.

The Ti content is comprised between 0.02% and 0.15% by weight. In one embodiment, the Ti content is comprised between 0.02 and 0.10% by weight, advantageously between 0.02 and 0.09% by weight, still more advantageously between 0.02 and 0.05% by weight.

The titanium has the effect of controlling the casting microstructure, in particular of refining the grain size.

The other elements have a content of at most 0.05% by weight each and 0.15% by weight in total. These consist of unavoidable impurities, the remainder is aluminum.

Each of these embodiments can be combined entirely or partly.

Advantageously, the wrought product made of a 2000 series aluminum alloy is selected amongst the designations AA2139, AA2039, AA2040, AA2124, AA2024, AA2027, AA2022, AA2042.

Advantageously, the wrought product made of a 2000 series aluminum alloy is a thin sheet metal, a thick sheet metal, a profile or a forged part. In a preferred embodiment, the wrought product is a sheet metal with a thickness of at least 30 mm, preferably larger than or equal to 50 mm, still more preferably larger than or equal to 90 mm.

The wrought product made of a 2000 series aluminum alloy is obtained by a standard production process. A raw form is cast from a bath of liquid metal with a composition in % by weight Cu 3.5-5.8; Mg 0.2-1.5; Mn≤0.9; Fe≤0.15; Si≤0.15; Zr≤0.25; Ag≤0.8; Zn≤0.8; Ti 0.02-0.15, unavoidable impurities≤0.05 each and ≤0.15 total; remainder aluminum.

Advantageously, the raw form is a plate, or a billet. Afterwards, the raw form is homogenized, then hot formed to obtain a wrought product made of a 2000 series aluminum alloy. Advantageously, the homogenization is performed at a temperature comprised between 490° C. and 530° C. for a duration of 10 h to 50 h. Advantageously, in the case of a plate, the plate is homogenized and then hot rolled to obtain a wrought product made of a 2000 series aluminum alloy. Advantageously, the wrought product made of a 2000 series aluminum alloy is a sheet metal with a thickness larger than or equal to 30 mm, preferably larger than or equal to 50 mm, still more preferably larger than or equal to 90 mm. Advantageously, the wrought product made of a 2000 series aluminum alloy is a sheet metal with a thickness smaller than or equal to 180 mm, preferably smaller than or equal to 150 mm.

The wrought product made of a 2000 series aluminum alloy comprising in % by weight, Cu 3.5-5.8; Mg 0.2-1.5; Mn≤0.9; Fe≤0.15; Si≤0.15; Zr≤0.25; Ag≤0.8; Zn≤0.8; Ti 0.02-0.15, unavoidable impurities≤0.05 each and ≤0.15 total; remainder aluminum undergoes a thermomechanical treatment including placing in a solution, quenching, work hardening and tempering.

Advantageously, the wrought product is placed in solution at a temperature comprised between 490° C. and 530° C. for a duration of 5 h to 20 h. Advantageously, the quenching is performed by immersing the product placed in solution in water at room temperature, conventionally around 22° C. (+/−10° C.) or by sprinkling the product using a spray.

Afterwards, work hardening is performed. Advantageously, this work hardening is carried out at cold. It may be carried out by tensioning or compression. Advantageously, the permanent strain rate is comprised between 1 and 9%, preferably between 3 and 5%.

Optionally, an additional forming step may be performed before tempering. This forming step may be performed by a high-energy hydroforming process. Preferably, this process is carried out on a thick sheet metal, typically with a thickness larger than or equal to 30 mm, preferably larger than or equal to 50 mm and still more preferably larger than or equal to 90 mm. This process may be an explosion hydroforming process. This type of process is described in the publication "Applications and capabilities of explosive forming" by D. J. Mynor et al. Journal of Materials Processing Technology 125-126 (2002) pp 1-25.

According to the invention, the wrought product undergoes a tempering, comprising at least two sequences. Preferably, the wrought product undergoes a tempering comprising two sequences.

According to the application, when a temperature interval is mentioned as "comprised between 130° C. and 180° C.", this means that the temperature bounds are included. Hence, it should be understood that when it is mentioned "between 130° C. and 180° C.", this should be understood as "from 130° C. to 180° C.".

First Sequence

The first sequence is intended to obtain the final mechanical properties of the product. In particular, the first sequence is such that it allows obtaining the best toughness—yield strength tradeoff. According to the invention, the first sequence consists of one or more heating, and/or isothermal holding and/or cooling step(s). The evolution of the temperature during the first sequence may be described by a function $T1^{\circ C.}(t)$ dependent on the time t. During the first sequence, the temperature reaches a maximum temperature $T1^{max}$ comprised between 130° C. and 180° C. Preferably, the maximum temperature $T1^{max}$ is reached during an isothermal step level. The duration of the first sequence is such that the hold time at a temperature comprised between 130° C. and 180° C. equates an equivalent duration $t1_{eq}^{160° C.}$ comprised between 10 h and 80 h, which equivalent duration $t1_{eq}^{160° C.}$ is calculated at the reference temperature of 160° C. according to the formula $$t1_{eq}^{160°C.} = \int dt \cdot \exp\left[-\frac{136000}{8,314} \cdot \left(\frac{1}{T1^{°C.}(t)+273} - \frac{1}{160+273}\right)\right] \quad \text{[Math 1]}$$

The function is integrated over the time period where the temperature expressed in ° C. is comprised between 130° C. and 180° C. This means that the function is integrated over the time period corresponding to the first crossing of the temperature of 130° C. in the ascending way, and the first crossing of the temperature of 130° C. in the descending way. In the case where the time period is discontinuous, the function should be integrated according to each of the time periods where the temperature is comprised between 130° C. and 180° C.

Preferably, the hold time at a temperature comprised between 130° C. and 180° C. during the first sequence equates an equivalent duration $t1_{eq}^{160° C.}$ of at least 15 h, 20 h, 24 h, or 30 h in order to obtain sufficient mechanical strength. Indeed, if the equivalent duration is too short, it is not possible to reach a sufficient elastic limit, typically reach a yield strength of at least 400 MPa in the direction TL (Transverse Long). Preferably, the hold time at a temperature comprised between 130° C. and 180° C. during the first sequence is such that the equivalent duration $t1_{eq}^{160° C.}$ is shorter than 70 h, advantageously shorter than 60 h, or 50 h, or 40 h in order to obtain sufficient ductility and toughness. Indeed, if the equivalent duration is too long, the ductility and toughness drop.

The first sequence may be preceded by a maturation step at room temperature. The duration of the maturation step may vary between a few minutes, a few hours or a few days. Preferably, the maturation duration is comprised between 10 minutes and 10 hours, preferably at most 4 hours.

In a preferred embodiment of the invention, the first sequence is a single step level (cf. FIG. 3). By "single step level", it should be understood a sequence comprising one single isothermal step level. Typically, a first single step level sequence comprises a temperature rise step, isothermal holding comprised between 130° C. and 180° C. and a cooling step.

Second Sequence

The second sequence is intended to improve resistance to corrosion under stress.

According to the invention, the second sequence induces a negligible evolution in the mechanical properties such as the yield strength, the breaking strength or the toughness. The yield strength, the breaking strength, or the toughness evolve by less than 10% between the end of the first sequence and the end of the second sequence, advantageously by less than 5%, still more advantageously by less than 3% or 2%. Preferably, the yield strength evolves by less than 3%, preferably by less than 2%. Preferably, the toughness evolves by less than 3%, preferably by less than 2%.

The Inventors have noticed that the second sequence does not significantly modify the amount of precipitates formed upon completion of the first sequence.

DSC, standing for Differential Scanning Calorimetry, is a thermal analysis technique. It measures the differences in heat exchange between a sample to be analyzed and a reference (in this case, alumina) This DSC technique is based on the fact that during a physical transformation, such as a phase transition, a certain amount of heat is exchanged with the sample to keep it at the same temperature as the reference. The direction of this heat exchange between the sample and the equipment depends on the endothermic or exothermic nature of the transition process. Thus, for example, if a product contains precipitates, when it is heated, these precipitates can dissolve in a temperature range under the effect of heat. The product will then absorb more heat to be able to increase its temperature at the same rate as the reference. The dissolution of the precipitates is an endothermic phase transition because it absorbs heat. Also, the sample could undergo exothermic processes, such as precipitation, when it transfers heat to the system.

By measuring the difference in heat flux between the sample and the reference, a differential scanning calorimeter can measure the amount of heat absorbed or released during a transition.

Using this technique, it is possible to estimate the amount of dissolved phases from the thermogram by calculating the surface area of the endothermic peak or dissolution peak, expressed in J/g. This dissolution peak according to the invention is comprised between about 200° C. and 300° C. By "about 200° C. and 300° C.", it should be understood that the dissolution peak may extend within a range comprised between +/−50° C. with respect to the range of 200° C.-300° C.

The Inventors have noticed that the surface area of the dissolution peak varies by less than 5% between the two sequences. Indeed, the Inventors have noticed that the value of the surface area of the dissolution peak after the second sequence, measured by DSC, which dissolution peak is comprised between about 200° C. and 300° C., is substantially equal to the value of the surface area of the dissolution peak measured after the first sequence. By substantially equal, it should be understood a difference less than or equal to 5%, advantageously less than or equal to 2%.

According to the invention, the second sequence consists of one or more heating, and/or isothermal holding and/or cooling step(s).

The evolution of the temperature during the second sequence may be described by a time-dependent function $T2^{\circ\ C.}(t)$. The second sequence is carried out at a temperature T2 lower than the maximum temperature $T1^{max}$ of the first sequence. This means that during the second sequence, the function $T2^{\circ\ C.}(t)$ is lower than the maximum temperature $T1^{max}$.

Preferably, the second sequence is carried out at a temperature T2 lower than 130° C., still more preferably lower than 125° C.

The second sequence is characterized by a hold time t2 at a temperature comprised between 100° C. and 130° C. This hold time t2 at a temperature comprised between 100° C. and 130° C. may be defined by an equivalent duration $t2_{eq}^{160°\ C.}$ calculated at the temperature of 160° C. according to the formula $$t2_{eq}^{160°C.} = \int dt \cdot \exp\left[-\frac{136000}{8{,}314}\cdot\left(\frac{1}{T2^{°C.}(t)+273}-\frac{1}{160+273}\right)\right] \quad \text{[Math 2]}$$

The temperature $T2^{\circ\ C.}(t)$ is expressed in ° C.

The function is integrated over the time domain where the product is held between 100° C. and 130° C. after the first sequence. According to the invention, the equivalent duration $t2_{eq}^{160°\ C.}$ thus calculated is shorter than or equal to 15% of the equivalent duration $t1_{eq}^{160°\ C.}$ calculated for the first sequence.

Preferably, the second sequence is characterized by a hold time t2 at a temperature comprised between 105° C. and 130° C., or between 105° C. and 125° C., or between 110° C. and 130° C., or between 110° C. and 125° C., such that the equivalent duration $t2_{eq}^{160°}$ calculated at 160° C. is shorter than or equal to 15% of the equivalent duration $t1_{eq}^{160°}$ calculated at 160° C. for the first sequence.

Holding at a temperature lower than 100° C., preferably lower than 105° C., still more preferably 110° C., for more prolonged time period does not allow improving the resistance to corrosion in the short transverse direction.

The equivalent duration $t2_{eq}^{160°}$ calculated at a temperature of 160° C., corresponding to the hold time t2 at a temperature comprised between 100° C. and 130° C., or between 105° C. and 130° C., or between 105° C. and 125° C., or between 110° C. and 130° C., or between 110° C. and 125° C. is shorter than or equal to 15% of the equivalent duration $t1_{eq}^{160°}$ calculated for the first sequence.

Preferably, the equivalent duration $t2_{eq}^{160°}$ corresponding to the hold time t2 at a temperature comprised between 100° C. and 130° C. or between 105° C. and 130° C., or between 105° C. and 125° C., or between 110° C. and 130° C., or between 110° C. and 125° C. is shorter than or equal to 10%, 5%, or 3.5% of the equivalent duration $t1_{eq}^{160°}$ calculated at 160° C. for the first sequence.

The Inventors have noticed that the corrosion of the wrought product under stress is improved if the second sequence is such that a sufficient duration comprised between 100° C. and 130° C. is performed. The equivalent duration $t2_{eq}^{160°}$ calculated at 160° C. is longer than or equal to 0.3%. An equivalent duration $t2_{eq}^{160°}$ shorter than 0.3% does not allow desensitizing the product to corrosion under stress. Still more preferably, the equivalent duration $t2_{eq}^{160°}$ is longer than or equal to 0.4%, 0.5%, 1%, 2% or 3% of the equivalent duration $t1_{eq}^{160°}$ calculated at 160° C. for the first sequence.

In an embodiment of the invention, the first and second sequences are carried out successively without any passage through the room temperature therebetween. In this case, the start of the second sequence takes place at the time when the temperature $T1^{\circ C.}(t)$ is lower than 130° C. as represented in FIG. 1.

In another embodiment of the invention, the first and second sequences are carried out successively with holding at room temperature therebetween. In this case, the start of the second sequence takes place at the time when the temperature $T1^{\circ C.}(t)$ is lower than 130° C. as represented in FIG. 2, the hold time t2 is equal to the cumulative hold times of the sequences in the temperature range comprised between 100° C. and 130° C.

The wrought product obtained according to the invention is suitable for aeronautical applications, in particular for components made as an integral structure. An integral structure is a monolithic structure consisting of a skin and a stiffener in one-piece. Advantageously, the wrought product obtained according to the invention is used for integral structures, such as fuselage, rib or spar elements.

The Inventors have noticed that the thermomechanical treatment according to the invention allowed obtaining better resistance to corrosion under stress. In a preferred embodiment, the thermomechanical treatment is particularly interesting on wrought products with a thickness larger than or equal to 30 mm, preferably larger than or equal to 50 mm or 90 mm, like a thick sheet metal, a profile or a forged product for which the resistance to corrosion under stress in the short transverse direction TC is desired. A wrought product made of a 2000 series aluminum alloy with a thickness larger than or equal to 30 mm comprising, in % by weight, Cu 3.5-5.8; Mg 0.2-1.5; Mn≤0.9; Fe≤0.15; Si≤0.15; Zr≤0.25; Ag≤0.8; Zn≤0.8; Ti 0.02-0.15 unavoidable impurities≤0.05 each and ≤0.15 total; remainder aluminum; that could be obtained by the thermomechanical treatment method according to the invention allows obtaining an average lifespan in corrosion under stress lower than or equal to 200 MPa imposed in the short transverse direction TC longer than 10 days. The tests are carried out according to the conditions of ASTM G47-98 (2019) using a tensioning device under constant load according to ASTM G49-85 (2019). In particular, in a preferred embodiment, the difference between the average lifespan and the standard deviation measured during the test is longer than 10 days, the tests being carried out according to the conditions of ASTM G47-98 (2019) using a tensioning device under constant load according to ASTM G49-85 (2019).

This product has a yield strength in the long transverse direction TL higher than or equal to 400 MPa.

The product according to the invention is used for aeronautical applications of integral structures such as fuselage, rib or spar elements.

EXAMPLES

Example 1

An AA2139 alloy, the composition of which is indicated in Table 1, has undergone, after homogenization at a temperature comprised between 490° C. and 530° C. for a duration of 10 h to 50 h, hot-rolling to obtain a final thickness of 120 mm. Afterwards, the sheet has been placed in solution between 490° C. and 530° C. for a duration of 5 h to 20 h then quenched and stress-relieved by controlled tensioning so as to obtain a permanent deformation between 2 and 4%. Afterwards, the sheet metal has been tested for corrosion under stress after different tempers as indicated in Table 2.

The equivalent times, as defined according to the invention, are calculated while taking into account the isothermal step levels and the temperature rise and drop phases.

Tempers including only one sequence are performed with a heating rate of 40° C./h up to 150° C., then at 20° C./h up to 160° C. The cooling rate is 30° C./h.

Tempers including two sequences are performed with the same heating and cooling rates. The two step levels are completed one after another without passage through a holding at room temperature.

TABLE 1

| | Si | Fe | Cu | Mn | Mg | Ti | Ag | Zr |
|---|---|---|---|---|---|---|---|---|
| Alloy A | 0.04 | 0.08 | 4.8 | 0.3 | 0.5 | 0.05 | 0.33 | <0.05 |

TABLE 2

| Reference | Ageing | Equivalent time at 160° C. (h) 1st sequence | Equivalent time at 160° C. (h) 2nd sequence | Ratio 2nd sequence/ 1st sequence (%) |
|---|---|---|---|---|
| A5 | 160° C. 36 h | 36.76 | 0.02 | 0.05 |
| A6 | 160° C. 36 h + 120° C. 20 h | 36.76 | 0.45 | 1.22 |
| A7 | 160° C. 48 h | 48.76 | 0.02 | 0.04 |
| A8 | 160° C. 48 h + 120° C. 20 h | 48.76 | 0.45 | 0.92 |

The stress corrosion tests (SCT) have been carried out in the short transverse direction of the sheet metal under the conditions of ASTM G47-98 (2019) using tensile specimens under an imposed stress of 200 MPa. The specimens are subjected to immersion emersion cycles in a 3.5% NaCl saline solution according to the conditions of ASTM G44-99 (2013). The tests have been carried out under constant load according to the recommendations of the standard ASTM G49-85 (2019). The tensile specimens with a diameter of 3.17 mm have been taken at mid-thickness of the sheet metal. The results are shown in Table 3.

The sheets have been tested to determine their static mechanical properties and their toughness. The yield strength Rp0.2, the breaking strength Rm and the elongation at break A, in the direction TL are reported in Table 4. The tensile specimens have been taken at mid-thickness and the toughness specimens used are CT20W40 (thickness B=20 mm, width W=40 mm according to the nomenclature of the standard ASTM E399) taken at quarter-thickness. Besides the value $K_q$ obtained according to the standard ASTM E399, the $K_{app}$ value is used as the test result. This consists of the stress intensity factor obtained for the tested specimen using as a load the maximum load recorded during the test, and as a crack length, the initial length of the crack after pre-cracking in fatigue; it is the same length as that used for the calculation of $K_q$.

TABLE 3

| Ref. | Ageing | Stress (MPa) | Duration (Days) | Minimum (Days) | Average (Days) | Standard deviation sigma (Days) | average-1*sigma (Days) |
|---|---|---|---|---|---|---|---|
| A5 | 160° C. 36 h | 200 | 7 | 7 | 7 | 1 | 6 |
| | | 200 | 7 | | | | |
| | | 200 | 8 | | | | |
| A6 | 160° C. 36 h + Invention | 200 | 23 | 16 | 23 | 7 | 16 |
| | 120° C. 20 h | 200 | 16 | | | | |
| | | 200 | 30 | | | | |
| A7 | 160° C. 48 h | 200 | 14 | 9 | 18 | 11 | 7 |
| | | 200 | 30 | | | | |
| | | 200 | 9 | | | | |
| A8 | 160° C. 48 h + Invention | 200 | 30 | 14 | 25 | 9 | 15 |
| | 120° C. 20 h | 200 | 30 | | | | |
| | | 200 | 14 | | | | |

The products A6 and A8 tested according to the invention have a longer average lifespan than the products obtained after a single step level tempering. None of the tested specimens has a lifespan shorter than 10 days. The products A6 and A8 tested according to the invention have an average lifespan and a standard deviation such that the difference between the average and the standard deviation is longer than 10 days.

TABLE 4

| Ref | Ageing | R0.2 (MPa) | Rm (MPa) | A (%) | Kapp (MPa · √m) | | Kq (MPa · √m) | |
|---|---|---|---|---|---|---|---|---|
| | | TL - T/2 | | | T-L | S-L | T-L | S-L |
| A5 | 160° C. 36 h | 400 | 445 | 9.2 | 37 | 33 | 36 | 33 |
| A6 | 160° C. 36 h + Invention 120° C. 20 h | 402 | 449 | 9.1 | 37 | | 37 | |
| A7 | 160° C. 48 h | 401 | 447 | 8.9 | 37 | 33 | 37 | 33 |
| A8 | 160° C. 48 h + Invention 120° C. 20 h | 408 | 451 | 8 | 37 | | 37 | |

Example 2

The same sheet metal as Example 1 has been tested according to other tempering conditions as indicated in Table 5. The corrosion tests under stress have been carried out under the same conditions as Example 1. The results are indicated in Table 6.

TABLE 5

| Reference | Ageing | Equivalent time at 160° C. (h) 1st sequence | 2nd sequence | Ratio 2nd sequence/1st sequence (%) |
|---|---|---|---|---|
| A11 | 160° C. 36 h + 93° C. 100 h | 36.76 | 0.02 | 0.05 |
| A12 | 160° C. 36 h + 120° C. 5 h | 36.76 | 0.13 | 0.35 |

TABLE 6

| Ref. | Ageing | Stress (MPa) | Duration (Days) | Minimum (Days) | Average (Days) | Standard deviation sigma (Days) | average-1sigma (Days) |
|---|---|---|---|---|---|---|---|
| A11 | 160° C. 36 h + | 200 | 8 | 8 | 9 | 2 | 7 |
| | 93° C. 100 h | 200 | 12 | | | | |
| | | 200 | 8 | | | | |
| A12 | 160° C. 36 h + Invention | 200 | 28 | 15 | 25 | 9 | 16 |
| | 120° C. 5 h | 200 | 32 | | | | |
| | | 200 | 15 | | | | |

The product A12 tested according to the invention has a significantly longer average lifespan than the product A11 obtained after tempering including two sequences but whose hold time t2 at a temperature comprised between 100° C. and 130° C. equates to an equivalent duration $t2_{eq}^{160°}$ shorter than 0.3% of the equivalent time duration $t1_{eq}^{160°}$ calculated for the first sequence. None of the specimens tested for reference A12 has a lifespan shorter than 10 days. The product A12 tested according to the invention has an average lifespan and a standard deviation such that the difference between the average and the standard deviation is longer than 10 days.

Example 3

An AA2139 alloy, whose composition is indicated in Table 7, has undergone, after homogenization between 490° C. and 530° C. for a duration of 10 h to 50 h, a hot-rolling to obtain a final thickness of 120 mm. Afterwards, the sheet metal has been placed in solution between 490° C. and 530° C. for a duration of 5 h to 20 h then quenched and stress-relieved by controlled tensioning so as to obtain a permanent strain between 2 and 4%. Afterwards, the sheet metal has been tested for corrosion under stress after different tempers as indicated in Tables 8 and 9.

TABLE 7

| | Si | Fe | Cu | Mn | Mg | Ti | Ag | Zr |
|---|---|---|---|---|---|---|---|---|
| Alloy B | 0.05 | 0.09 | 4.9 | 0.3 | 0.5 | 0.09 | 0.32 | <0.05 |

The stress corrosion tests have been carried out under the same conditions as Example 1.

TABLE 8

| Reference | Ageing | Equivalent time at 160° C. (h) 1st sequence | Equivalent time at 160° C. (h) 2nd sequence | Ratio 2nd sequence/ 1st sequence (%) |
|---|---|---|---|---|
| B5 | 160° C. 36 h | 36.76 | 0.02 | 0.05 |
| B6 | 160° C. 36 h + 120° C. 20 h | 36.76 | 0.45 | 1.22 |

TABLE 9

| Ref. | Ageing | | Stress (MPa) | Duration (Days) | Minimum (Days) | Average (Days) | Standard deviation sigma (Days) | average-1sigma (Days) |
|---|---|---|---|---|---|---|---|---|
| B5 | 160° C. 36 h | | 200 | 3 | 3 | 3 | 0 | 3 |
| | | | 200 | 3 | | | | |
| | | | 200 | 3 | | | | |
| B6 | 160° C. 36 h + 120° C. 20 h | invention | 200 | >30 NR | 16 | >21 | | |
| | | | 200 | 16 | | | | |
| | | | 200 | 16 | | | | |

The tempering including two sequences according to the invention leads to a substantially improved resistance to corrosion under stress.

Example 4

Stress corrosion tests have been carried out on a sheet metal made of AA2139 identical to Example 1 which had undergone single step level tempering for 36 h at 160° C. The sheet metal has been tested in the short transverse direction under constant load at 200 MPa of imposed stress and under constant strain at 276 MPa of imposed stress. The results are indicated in Table 10.

TABLE 10

| Ref. | Ageing | | Stress (MPa) | Duration (Days) | Minimum (Days) | Average (Days) | Standard deviation (Days) | average-1sigma (Days) |
|---|---|---|---|---|---|---|---|---|
| A5 | 160° C. 36 h | Constant load | 200 | 7 | 7 | 7 | 1 | 6 |
| | | | 200 | 7 | | | | |
| | | | 200 | 8 | | | | |
| | | Constant strain | 276 | 13 | 12 | 12 | 1 | 11 |
| | | | 276 | 12 | | | | |
| | | | 276 | 12 | | | | |

It should be observed that the tests under constant strain induce a longer average lifespan than that obtained under constant load in spite of a higher applied stress. This example confirms that tests under constant strain are less severe than those carried out under constant load.

Example 5

The same sheet metal as that described in Example 1 has been tested for marine corrosion exposure under stress. The tests have consisted in placing tensile specimens in a marine atmosphere loaded at 200 MPa of imposed stress, under constant load. This corresponds to the same stress conditions as those used in Example 1. They meet the conditions of ASTM G49-85 (2019).

The resistance to marine corrosion exposure under stress of the sheet metal has been tested for two tempering conditions, identical to those disclosed in Example 1, and corresponding to the single step level tempering for 36 h at 160° C. and to tempering according to invention for 36 h at 160° C.+20 h 120° C.

The results are reported in Table 11.

TABLE 11

| Ref. | Ageing | | Stress (MPa) | Duration (Days) |
|---|---|---|---|---|
| A5 | 160° C. 36 h | | 200 | 25 |
| | | | 200 | 17 |
| | | | 200 | 67 |
| A6 | 160° C. 36 h + 120° C. 20 h | invention | 200 | >540 |
| | | | 200 | >540 |
| | | | 200 | >540 |

The sheet metal having undergone tempering according to the invention has a better resistance to corrosion under stress in a marine atmosphere. After 18 months of exposure (about 540 days), none of the specimens has broken.

Example 6

Stress corrosion tests have been performed on a sheet metal made of AA2139 identical to Example 1 having undergone single step level tempering and two-step level tempering according to the invention. The single step level tempering includes only one sequence and is performed with a heating rate of 40° C./h up to 150° C., then 20° C./h up to 168° C. The cooling rate is 30° C./h. The tempering according to the invention including two sequences has undergone for the first sequence the same heating or cooling rates as the tempering including only one single sequence. The second sequence is carried out following the first sequence without passage through the ambient temperature. Upon completion of the second sequence, the sheet metal is cooled down at 30° C./h.

TABLE 12

| Reference | Ageing | Equivalent time at 160° C. (h) 1st sequence | Equivalent time at 160° C. (h) 2nd sequence | Ratio 2nd sequence/ 1st sequence (%) |
|---|---|---|---|---|
| A13 | 168° C .18 h | 37.43 | 0.02 | 0.05 |
| A14 | 168° C. 18 h + 120° C. 5 h | 37.43 | 0.13 | 0.35 |

The products have been tested in the short transverse direction under constant load at 200 MPa of imposed stress. The results are illustrated in Table 13.

TABLE 13

| Ref. | Ageing | | Stress (MPa) | Duration (Days) | Minimum (Days) | Average (Days) | Standard deviation sigma (Days) | average-1sigma (Days) |
|---|---|---|---|---|---|---|---|---|
| A13 | 168° C. 18 h | | 200 | 4 | 1 | 3 | 2 | 1 |
| | | | 200 | 5 | | | | |
| | | | 200 | 1 | | | | |
| A14 | 168° C. 18 h + 120° C. 5 h | Invention | 200 | 11 | 11 | 20 | 10 | 10 |
| | | | 200 | 19 | | | | |
| | | | 200 | 30 | | | | |

Differential scanning calorimetry measurements, also called DSC (Differential scanning Calorimetry) measurements, have been performed on the two products A13 and A14. FIG. 4 represents the obtained thermograms. One could notice that the two thermograms are similar.

A dissolution peak (10, 10') located between 200° C. and 300° C. is observed (FIG. 4) in both cases. The precipitates in presence are dissolved during heating, which is accompanied by a drop in the measured enthalpy. The amount of precipitates in presence upon tempering is estimated by integrating the surface area of the peak comprised under the baseline of the curve. The baseline is representative of the evolution of the enthalpy with the temperature if the sample did not undergo any physical transformation. This baseline may be obtained by using the baseline of the reference sample which does not undergo any physical transformation in the considered temperature range. It may also be estimated by extrapolating the measured curve (cf. FIG. 5). In the case of the example, a dissolution peak surface area of 4.98 J/g is measured for sample A13 and a dissolution peak surface area of 4.90 J/g for sample A14. The difference between the two is 1.6%.

The amount of precipitates formed upon tempering is similar for the considered two heat treatments. However, an improvement in the resistance to corrosion is actually observed for sample A14, having undergone tempering according to the invention.

The invention claimed is:

1. A method for thermomechanical treatment of a wrought product made of a 2000 series aluminum alloy comprising, in % by weight, Cu 3.5-5.8;

Mg 0.2-1.5;

Mn≤0.9;

Fe≤0.15;

Si≤0.15;

Zr≤0.25;
Ag≤0.8;
Zn≤0.8;
Ti 0.02-0.15
unavoidable impurities ≤0.05 each and ≤0.15 total; remainder aluminum, which thermomechanical treatment comprises placing in solution, quenching, work hardening, and tempering wherein the tempering comprises at least two sequences, a first sequence whose temperature expressed in ° C. is described by a function T1° C. (t) dependent on the time t, such that the reached maximum temperature $T1^{max}$ is comprised between 130° C. and 180° C. and the hold time t1 at a temperature comprised between 130° C. and 180° C. is such that the equivalent duration $t1_{eq}^{160°}$ is comprised between 10 h and 80 h, which equivalent duration $t1_{eq}^{160°}$ is calculated at a temperature of 160° C. according to the formula $$t1_{eq}^{160°C.} = \int dt \cdot \exp\left[-\frac{136000}{8,314} \cdot \left(\frac{1}{T1^{°C.}(t)+273} - \frac{1}{160+273}\right)\right] \quad \text{[Math 1]}$$

and a second sequence whose temperature expressed in ° C. is described by a function T2° C. (t), dependent on the time t whose temperature is such that T2° C. (t)<$T1^{max}$ and whose hold time t2 at a temperature comprised between 100° C. and 130° C. is such that the equivalent duration $t2_{eq}^{160°}$ calculated at a temperature of 160° C. according to the formula $$t2_{eq}^{160°C.} = \int dt \cdot \exp\left[-\frac{136000}{8,314} \cdot \left(\frac{1}{T2^{°C.}(t)+273} - \frac{1}{160+273}\right)\right] \quad \text{[Math 2]}$$

is comprised between 0.3% and 15% of the equivalent duration $t1_{eq}^{160°}$ calculated for the first sequence.

2. The thermomechanical treatment method according to claim 1, wherein the temperature of the second sequence T2° C. (t) is lower than 130° C.

3. The thermomechanical treatment method according to claim 1, wherein the hold time t2 of the second sequence comprised between 105° C. and 130° C. corresponds to an equivalent duration $t2_{eq}^{160°}$ comprised between 0.3% and 15% of the equivalent duration $t1_{eq}^{160°}$ calculated for the first sequence.

4. The thermochemical treatment method according to claim 1, wherein the equivalent duration $t2_{eq}^{160°}$ is longer than or equal to 0.5% and shorter than or equal to 15%, optionally longer than or equal to 1% and shorter than or equal to 15%; of the equivalent duration $t1_{eq}^{160°}$ calculated for the first sequence.

5. The thermochemical treatment method according to claim 1, wherein the equivalent duration $t2_{eq}^{160°}$ is longer than or equal to 0.3% and shorter than or equal to 10%, optionally longer than or equal to 0.3% and shorter than or equal to 5%; of the equivalent duration $t1_{eq}^{160°}$ calculated for the first sequence.

6. The thermomechanical treatment method according to claim 1, wherein the first sequence comprises a single isothermal step level.

7. The thermomechanical treatment method according to claim 1, wherein the wrought product is a thin sheet metal or a thick sheet metal or a profile or a forged part.

8. The thermomechanical treatment method according to claim 1, wherein the wrought product is a thick sheet metal having undergone a forming step by high-energy hydroforming before tempering.

9. The thermomechanical treatment method according to claim 1, wherein the wrought product made of a 2000 series aluminum alloy is selected from among AA2139, AA2039, AA2040, AA2124, AA2024, AA2027, AA2022, AA2042.

10. The thermomechanical treatment method according to claim 1, wherein the wrought product made of a 2000 series aluminum alloy comprises, in % by weight, Cu 3.9-5.2;
Mg 0.2-0.9;
Mn 0.1-0.6;
Fe≤0.15;
Si≤0.15;
Zr≤0.15;
Ag≤0.6;
Zn≤0.8;
Ti 0.02-0.15
unavoidable impurities≤0.05 each and ≤0.15 total; remainder aluminum.

11. The thermomechanical treatment method according to claim 1, wherein the wrought product made of a 2000 series aluminum alloy comprises, in % by weight, Cu 4.5-5.0;
Mg 0.40-0.90;
Mn 0.20-0.50;
Fe≤0.15;
Si≤0.15;
Zr≤0.05;
Ag 0.10-0.50;
Zn≤0.5;
Ti 0.02-0.15
unavoidable impurities≤0.05 each and ≤0.15 total; remainder aluminum.

12. The thermomechanical treatment method according to claim 1, wherein the value of the surface area of the dissolution peak, after the second sequence, measured by DSC, which dissolution peak is comprised between about 200° C. and 300° C., is substantially equal to the value of the surface area of the dissolution peak measured after the first sequence, by substantially equal wherein a difference less than or equal to 5%, optionally less than or equal to 2%.

* * * * *